United States Patent [19]

Loutfy et al.

[11] Patent Number: 4,882,254

[45] Date of Patent: Nov. 21, 1989

[54] PHOTOCONDUCTIVE IMAGING MEMBERS WITH MIXTURES OF PHOTOGENERATOR PIGMENT COMPOSITIONS

[75] Inventors: Rafik O. Loutfy, Willowdale; Ah-Mee Hor; George Liebermann, both of Mississauga; Alan J Toth, Burlington; Cheng-Kuo Hsiao, Mississauga, all of Canada; Kathleen M. Carmichael, Williamson; Emery G. Tokoli, Rochester, both of N.Y.

[73] Assignee: Xerox Corporation, Stamford, Conn.

[21] Appl. No.: 214,990

[22] Filed: Jul. 5, 1988

[51] Int. Cl.[4] ..... G03G 5/10

[52] U.S. Cl. ..... 430/59; 430/78; 430/83

[58] Field of Search ..... 430/58, 59, 78, 83

[56] References Cited

U.S. PATENT DOCUMENTS

| | | | |
|---|---|---|---|
| 3,816,118 | 6/1974 | Byrne | 96/1.5 |
| 3,871,882 | 3/1975 | Wiedemann | 96/1.5 |
| 3,992,205 | 11/1976 | Wiedermann | 96/1.6 |
| 4,429,029 | 1/1984 | Hoffmann et al. | 430/57 |
| 4,431,721 | 2/1984 | Jost et al. | 430/37 |
| 4,578,334 | 3/1986 | Borsenberger et al. | 430/59 |
| 4,582,772 | 4/1986 | Teuscher et al. | 430/64 |
| 4,606,987 | 8/1986 | Matsuura et al. | 430/59 |
| 4,714,666 | 12/1987 | Wiedemann et al. | 430/59 |
| 4,719,163 | 1/1988 | Staudenmayer et al. | 430/58 |
| 4,728,592 | 3/1988 | Ohaku et al. | 430/59 |
| 4,755,443 | 7/1988 | Sozuki et al. | 430/58 |

*Primary Examiner*—John L. Goodrow
*Attorney, Agent, or Firm*—E. O. Palazzo

[57] ABSTRACT

A layered photoresponsive imaging member comprised of a supporting substrate; a photogenerator layer comprised of a mixture of first and second pigments; and an aryl amine hole transport layer, said mixture comprised of perylenes and phthalocyanines; polycyclic quinones and phthalocyanines; and perinones and phthalocyanines.

36 Claims, 4 Drawing Sheets

PHOTOCONDUCTIVE IMAGING MEMBERS WITH MIXTURES OF PHOTOGENERATOR PIGMENT COMPOSITIONS

BACKGROUND OF THE INVENTION

This invention is generally directed to photoresponsive imaging members, and more specifically the present invention is directed to layered photoresponsive members having incorporated therein pigment mixture compositions. Thus, in one embodiment the present invention envisions the selection of specific mixtures of photogenerating pigments in photoresponsive imaging members containing therein aryl amine hole transport molecules. The aforementioned photoresponsive imaging members can be negatively charged when the photogenerating layer is situated between the hole transport layer and the substrate; or positively charged when the hole transport layer is situated between the photogenerating layer and the supporting substrate. Additionally, the photoresponsive imaging members with the photogenerating pigment mixture compositions as photogenerator substances, and wherein the member further includes therein an aryl amine hole transport layer are useful in electrophotographic imaging processes, especially xerographic processes wherein negatively charged or positively charged images are rendered visible with developer compositions of the appropriate charge. These imaging members are sensitive to wavelengths of from about 400 to about 900 nanometers, thereby enabling their utilization with gas and diode lasers, light emitting diodes (LED), broadband light sources such as tungsten, fluorescent, and xenon lamps. The broad spectrum response of the imaging members of this invention enable their selection for multifunction electrophotography processes employing the aforementioned light sources.

Layered photoresponsive imaging members are generally known, reference for example U.S. Pat. No. 4,265,990, the disclosure of which is totally incorporated herein by reference, wherein there is described an imaging member comprised of a photogenerating layer, and an aryl amine hole transport layer. Examples of substances useful in the photogenerating layer of this patent include trigonal selenium, metal phthalocyanines, and metal free phthalocyanines. Additionally, there is described in U.S. Pat. No. 3,121,006 a composite xerographic photoconductive member comprised of finely divided particles of a photoconductive inorganic compound dispersed in an electrically insulating organic resin binder. The binder materials disclosed in the '006 patent comprise a material which is incapable of transporting for any significant distance injected charge carriers generated by the photoconductive particles.

Organic photogenerating pigments such as perylenes, bisazos, perinones, and polycyclic quinones are well known for electrophotography applications. Generally, layered imaging members with the aforementioned pigments evidence acceptable photosensitivity in the visible region of the spectrum and hence they are particularly suitable for electrophotogaphy process where visible light sources such as tungsten, fluorescent, and xenon lamps operate. However, these classes of pigments in many instances have low or negligible photosensitivity in the near infrared region of the spectrum, that is for example above 700 nanometers, thereby preventing their selection for photoresponsive imaging members in electronic printers wherein electronic light emitting devices, such as GaAs diode lasers, are commonly used as a light source to create electrostatic image on the imaging members. Also, some of the above mentioned organic pigments have narrow and restricted spectral response range such that they cannot reproduce certain colors present in the original documents; and inferior copy quality also results in these situations.

Moreover, the selection of phthalocyanine pigments as photoresponsive members in laser based electrophotography printers have been described in numerous patents. Both metal-free phthalocyanines and metal phthalocyanines have optical absorption in the region of 750 to 850 nonometers where GaAs diode lasers operate. Therefore, these spectral characteristics render phthalocyanines particularly suitable for use in conjunction with the lasers imaging process. Unfortunately, the phthalocyanines exhibit a low optical absorption in the wavelength region of from 450 to 550 nanometers. Therefore, when the phthalocyanine is selected for white light imaging processes, the lack of photosensitivity in this region results in some loss of red color copyability. Accordingly, the phthalocyanines are generally not suitable for use in the aforesaid photocopying applications, especially when the original documents possess red color images.

While the above-described photoresponsive imaging members are suitable for their intended purposes, there continues to be a need for improved members, particularly layered members, having incorporated therein specific pigment mixture compositions and aryl amine hole transport compounds. Additionally, there continues to be a need for layered imaging members comprised of specific aryl amine charge transport compositions; and as photogenerating materials pigment mixtures with panchromatic sensitivity, low dark decay characteristics, high charge acceptance values, and wherein these members can be used for a number of imaging cycles in a xerographic imaging or printing apparatus. Furthermore, there continues to be a need for photoresponsive imaging members which can be positively or negatively charged thus permitting the development of images, including color images, with positively or negatively charged toner compositions. Moreover, there continues to be an important need for disposable imaging members with nontoxic organic pigments. Also, there is a need for imaging members useful in xerographic imaging processes, and xerographic printing systems wherein, for example, light emitting diodes (LED), helium cadmium, or halium neon lasers, GaAs diode lasers are selected; and wherein these members are particularly sensitive to the visible and infrared region of the spectrum, that is, from about 400 to about 900 nanometers. Additionally, photoresponsive imaging members containing the pigment mixtures illustrated herein as a photogenerator layer are capable of performing mutlifunction electrophotography applications, such as white light photocopying and electronic printing.

SUMMARY OF THE INVENTION

It is an object of the present invention to provide improved photoresponsive imaging members with many of the advantages illustrated herein, and which are substantially inert to the users thereof.

It is yet another object of the present invention to provide layered photoresponsive imaging members with photosensitivity in the visible and infrared regions of the spectrum, that is, from about 400 to about 900 nanometers.

A further specific object of the present invention resides in the provision of an improved photoresponsive imaging member with an aryl amine hole transport layer, and a photogenerator layer comprised of a mixture of photogenerating compositions.

In yet another specific object of the present invention there are provided negatively charged layered photoresponsive imaging members comprised of mixtures of photogenerator pigments optionally dispersed in a resinous binder, and thereon a hole transport layer comprised of aryl amine molecules.

There is provided in another object of the present invention positively charged layered photoresponsive imaging members with a top photogenerator pigment mixture, optionally dispersed in a resinous binder, and thereunder a hole transport layer comprised of aryl amine molecules.

It is yet another object of the present invention to provide imaging and printing methods with the improved photoresponsive imaging members illustrated herein.

These and other objects of the present invention are accomplished by the provision of photoconductive imaging members with a sensitivity of from about 400 to about 900 nonometers. More specifically, the present invention is directed to layered imaging members comprised of a supporting substrate, a photogenerator layer comprised of a mixture of photogenerating pigments selected from the classes of perylenes, phthalocyanines, polycyclic quinones, perinones, and azo components.

Examples of photogenerating mixtures include metal phthalocyanines, or metal free phthalocyanines with quinacridones, perylenes, anthanthrones, perinones, pyranthrones, indogoides, bisazos, and the like. Generally, from about 10 to about 90 percent of the first pigment is present, and from about 90 to 10 percent of the second pigment. By controlling the ratio of pigments in the mixture, one can tailor the spectral response characteristics of photoresponsive elements in a desired manner such that various purposes of electrophotography imaging processes are achieved, including for example (i) extending the spectral response of the visible light pigment to the near infrared region, (ii) correcting the spectral response of a pigment such that the color copyability is improved, and (iii) equating the spectral response of the imaging member to exposure systems used. Preferred mixtures include those comprised of perylenes and phthalocyanines; anthanthrones and phthalocyanines; bisazos and phthalocyanines; and perionones and phthalocyanines. Typically, the proportion of photogenerating pigments by weight in the mixture is from about 1 to 1 to about 1 to 3, however, other ratios may be suitable providing the objectives of the present invention are achieved. The photogenerating ratio is determined by the shape of spectral response characteristics one intends to create for the photoresponsive imaging member to enable compatibility with the illuminating light sources selected for the electrophotographic processes.

Specifically, in one embodiment the present invention is directed to a supporting substrate, a photogenerator layer comprised of a mixture of first and second pigments, and an aryl amine hole transport layer, said mixture comprised of perylenes and phthalocyanines; polycylic quinones and phthalocyanines; and perinones and phthalocyanines.

Examples of phthalocyanines include metal-free phthalocyanine, and various metal phthalocyanines as described in F. H. Moser and A. L. Thomas, *The Phthalocyanines,* Vols. I and II, published by CRC Press Inc., 1983, the disclosure of which is totally incorporated herein by reference. Particularly useful phthalocyanines are those possessing peak absorption in the range of 750 to 850 nonometers, such as x-form metal-free phthalocyanine, vanadyl phthalocyanine, chloroindium phthalocyanine, and the like.

The perylene pigment compositions can be selected from the group consisting of

I. A Mixture of Cis and Trans Isomers of the Formulas

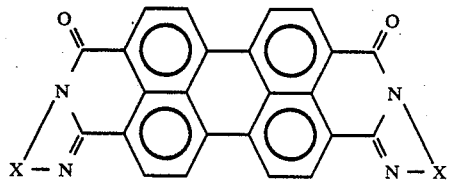

CIS

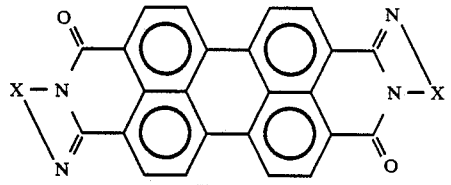

TRANS wherein X is o-phenylene, pyridimediyl, pyrimidinediyl, phenanthrenediyl, naphthalenediyl, and the corresponding methyl, nitro, chloro, and methoxy substituted derivatives; and II. Perylene Pigment Compounds

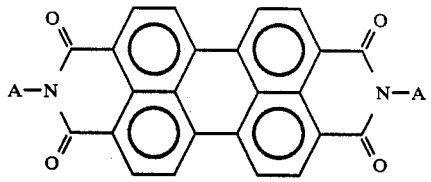

wherein A is hydrogen, lower alkyl of from 1 to about 4 carbon atoms, aryl, substituted aryl, arylalkyl, alkoxyalkyl, carboxylate, a heterocyclic group, alkoxyaryl; specific examples of which include methyl, ethyl, phenyl, methoxy, ethoxy, propoxy, pyrroles, furan, imidazole, esters, and quinolines;

III. Benzimidazole Perylenes

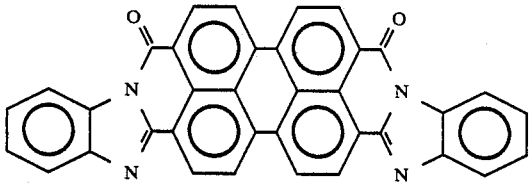

CIS

-continued

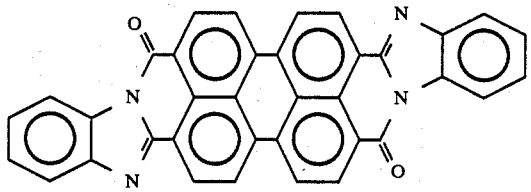

TRANS and

IV.

N,N'—Diphenyl-3,4,9,10-Perylenebis(Dicarboximide)

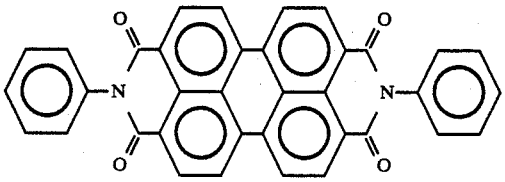

The known perylene compositions illustrated herein are generally prepared by the condensation reaction of perylene 3,4,9,10 tetracarboxylic acid, or the corresponding anhydrides with an appropriate amine in quinoline, in the presence of a catalyst, and with heating at elevated temperatures, about 180° C. to about 230° C., the details of which are described in German Patent Publication Nos. 2,451,780; 2,451,781; 2,451,782; 2,451,783; 2,451,784; 3,016,765; French Pat. No. 7723888; British Pat. Nos. 857,130; 901,694; and 1,095,196; and U.S. Pat. No. 4,587,189; the disclosure of each of the aforementioned publications and patents being totally incorporated herein by reference.

Examples of polycyclic quinones, which can be selected for the photogenerator mixture, are illustrated in U.S. Pat. No. 3,877,935, the disclosure of which is totally incorporated herein by reference. Halogenated quinones, such as brominated and chlorinated derivatives of anthanthrone, pyranthrone, dibenzyrenequinone, are particularly useful for the imaging members of the present invention.

Examples of perinones, which can be selected for the photogenerator mixture, are imidazole perinones described in U.S. Pat. No. 3,879,200 and U.S. Ser. No. 086,333, the disclosures of which are totally incorporated herein by reference. The preferred perinones are benzimidazole and naphthimidazole perinones.

The photoresponsive imaging members of the present invention can be prepared by a number of methods, the process parameters and the order of coating of the layers being dependent on the member desired. These imaging members are prepared by deposition of the photogenerator layer on a supporting substrate with an adhesive layer thereon, and subsequently depositing by solution coating the hole transport layer. The imaging members suitable for positive charging can be prepared by reversing the order of deposition of photogenerator and hole transport layers. More specifically, the photogenerating pigment mixture can be prepared by known coprecipitation methods. This is particularly suitable if one or more of the pigment components have large particle size, that is greater than 10 microns average diameter. Two or more pigments are first completely dissolved in a suitable solvent A, such as inorganic acids or organic acids of the formula R-X wherein R is an alkyl group, containing from about 4 carbon atoms to about 22 carbon atoms, including methyl, ethyl, propyl, and butyl, an aryl group, including naphthyl groups, or cycloalkyl groups, and the like; and X is a group capable of yielding anions, such as $-SO_3H$, $-OSO_3H$ or $-PO_3H_2$, and the like. The organic R groups may contain substituents thereon, or may be unsubstituted; examples of substituents including halogen, hydroxy, ethers, carbonyl, nitro, or mixtures thereof, and the like. Illustrative specific examples of inorganic acids selected are sulfuric acid and examples of organic acids are methanesulfonic acid, and dodecylbenzenesulfonic acid. The solution resulting is then added dropwise to a mechanically stirred solvent B in which the photogenerating pigments have a very low or negligible solubility. The aforesaid nonsolubilizing solvent B can be selected from a variety of inorganic or organic solvents such as water, alcohols including methanol, ethanol, butanol, propanol, and mixtures thereof; ethyl ketone, methyl ketone, toluene, dimethylformamide, and the like. Also, the nonsolubilizing solvent may contain bases such as triethylamine, ammonia, and the like, which function to neutralize the solubilizing acid and hence facilitate the precipitation of the photogenerating pigment mixture. The pigments would then coprecipitate out as a homogeneous powder mixture which can be separated from the solvent by filtration and further purified and dried. In one specific embodiment of the present invention, the pigment mixture of benzimidazole perylene and vanadyl phthalocyanine is prepared in this manner. Thus, for example, the perylene and phthalocyanine pigments are dissolved in sulfuric acid to form a solution, which is then added to water to affect the precipitation of pigment mixture, reference Example I. The prepared pigment mixture is then selected for the preparation of a polymeric slurry by mixing with polymers and solvents with various devices such as ball mills, attritors, or paint shakers. The polymer slurry thus obtained is then coated onto suitable substrates to form photogenerator layers by a variety of coating techniques such as spray coating, web coating, and dip coating. However, when the pigment components are in a fine powder state, one can prepare the polymeric slurry by directly mixing pigments, polymers, and solvents. This approach is illustrated in another embodiment of this invention where the vanadyl phthalocyanine and dibromoanthanthrone pigments are used directly in preparing the slurry, reference Example III.

In another approach, the photogenerator layer is prepared by co-evaporation techniques. In a vacuum coater equipped with two or more evaporation sources, which can be heated by electric current or electron beam, a suitable substrate is mounted above the evaporation sources. Pigments are loaded into evaporation sources and by separately adjusting the power output to each source, the sublimation temperature and hence the evaporation rate of each pigment are controlled. The composition of pigment mixture deposited onto the substrate is, therefore, determined by the amount of each pigment reaching the substrate. A single evaporation source can be also used if the pigments have the similar evaporation characteristics, for example similar vapor pressure, and are not reacting with each other at the temperature when they evaporate. In this situation, the composition of the pigment mixture formed in the photogenerator layer is determined by the ratio of pigment components in the evaporation source.

Imaging members having incorporated therein the pigment mixtures illustrated herein are useful in various electrostatographic imaging systems, particularly those conventionally known as xerographic processes. Specifically, the imaging members of the present invention are useful in xerographic imaging processes wherein the photogenerating layer absorbs light of a wavelength of from about 400 nanometers to about 900 nanometers. In these processes, electrostatic latent images are initially formed on the imaging member followed by development, thereafter transferring the image to a suitable substrate, and subsequently fixing this image.

Moreover, the imaging members of the present invention can be selected for electronicprinting processes with liht emitting devices, such as gas and solid state lasers, and light emitting diodes.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Preferred embodiments will now be illustrated with reference to specific photoresponsive imaging elements containing the pigment mixture as photogenerator layer.

Figure 1:
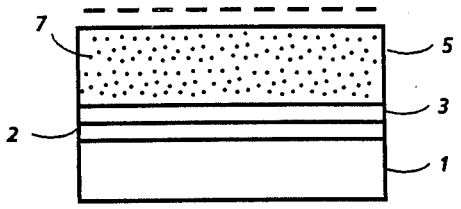
FIG. 1 is a partially schematic cross-sectional view of a negatively charged photoresponsive imaging member of the present invention.

Illustrated in FIG. 1 is a negatively charged photoresponsive imaging member of the present invention comprised of a substrate 1, an adhesive layer 2, a photogenerator layer 3 comprised of a mixture containing 10 to 90 percent by weight of the cis and trans isomers of benzimidazole perylene (Formula III) and 10 to 90 percent by weight of vanadyl phthalocyanine optionally dispersed in a resinous binder; and a charge transport layer 5 comprised of N,N'-diphenyl-N,N'-bis(3-methylphenyl)-[1,1'-biphenyl]-4,4'-diamine, 35 percent by weight, dispersed in 65 percent by weight of a polycarbonate resinous binder 7.

Figure 2:
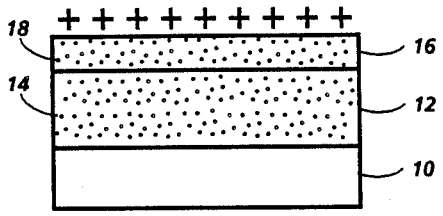
FIG. 2 is a partially schematic cross-sectional view of a positively charged photoresponsive imaging member of the present invention.

Illustrated in FIG. 2 is a positively charged photoresponsive imaging member of the present invention comprised of a substrate 10, a charge transport layer 12 comprised of 35 percent by weight of N,N'-diphenyl-N,N'-bis(3-methylphenyl)-[1,1'-biphenyl]-4,4'-diamine, dispersed in 65 percent by weight of a polycarbonate resinous binder 14, and a photogenerator layer 16 comprised of a mixture containing 10 to 90 percent by weight of the cis and trans isomers of benzimidazole perylene; and 10 to 90 percent by weight of vanadyl phthalocyanine optionally dispersed in a resinous binder 18.

Figure 3:
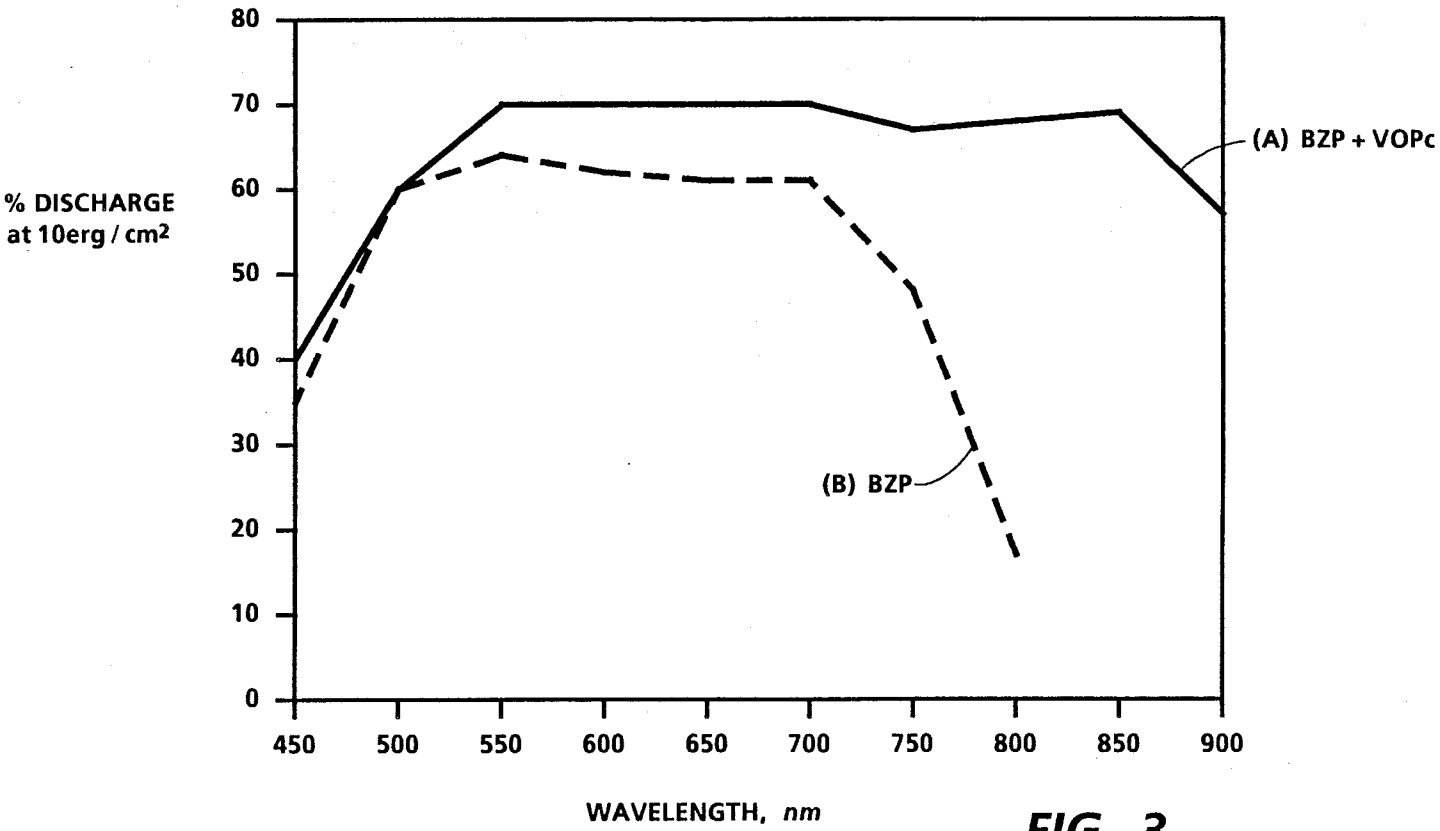
FIG. 3 represents the spectral response characteristics of a photoresponsive imaging member with a 1 to 1 by weight photogenerating mixture comprised of benzimidazole perylene/vanadyl phthalocyanine mixture as compared to that of benzimidazole perylene.

The improvement in infrared photosensitivity for the imaging member of FIG. 1 is illustrated in FIG. 3. In the first member, line (A), the photogenerator layer is comprised of a 1 to 1 mixture of benzimidazole perylene and vanadyl phthalocyanine dispersed in a resinous binder. In the second member, which is comprised of the same layers as FIG. 1 except that the photogenerator layer contains one pigment, namely, benzimidazole perylene dispersed in binder. The spectral response of these two members are shown as lines (A) and (B), respectively, in FIG. 3. Specifically, line (A) represents the spectral response characteristics of the aforementioned photoresponsive member containing a mixture of benzimidazole perylene and vanadyl phthalocyanine pigments in a one to one ratio by weight, as a photogenerator layer, whereas line (B) depicts the spectral response of a photoreceptor incorporating benzimidazole perylene photogenerator layer. Line (A) evidences extended and higher photosensitivity in the infrared region above about 700 nanometers as compared to line (B). Thus, the addition of a second pigment, such as vanadyl phthalocyanine, to the benzimidazole perylene in the photogenerator layer improves the photosensitivity of the latter in the infrared region, particularly from 750 to 850 nanometers, to render it usable, for example, with GaAs laser based imaging processes.

Similarly, there are included within the present invention photoresponsive imaging members as described herein with reference to FIG. 1 with the exception that there can be selected as one of the photogenerating pigments the perylene N,N'-diphenyl-3,4,9,10-perylenebis(dicarboximide) Formula IV. Also envisioned are positively charged imaging members as described with reference to FIG. 2, with the exception that there is selected as one of the photogenerators the perylene N,N'-diphenyl-3,4,9,10-perylenebis(dicarboximide) of Formula IV instead of in each instance the benzimidazole perylene of Formula III.

Furthermore, there is included in this invention photoresponsive imaging members as described herein with reference to FIG. 1 with the exception that the perylene pigment is replaced by dibromoanthanthrone, a commercial pigment available as Monolite Red 2Y from ICI. The improvement of the spectral response of vanadyl phthalocyanine in the region of 450 to 550 nanometers by dibromoanthanthrone is shown in FIGS. 4 and 5, and the mixture is replaced by vanadyl phthalocyanine line (B).

Two photoresponsive members possessing the same device structure represented in FIG. 1 were also prepared with the exception that a different photogenerator layer is incorporated into each member. In the first member, the photogenerator layer contains a mixture of vanadyl phthalocyanine and dibromoanthanthrone in 1 to 1 weight ratio, and the second member contains only vanadyl phthalocyanine. FIG. 4, line (A) illustrates the spectral response characteristics of a photoresponsive member incorporating a mixture of vanadyl phthalocyanine and dibromoanthanthrone pigments, in a one to one ratio by weight, as the photogenerator layer, whereas line (B) shows the spectral response of the same imaging member with a vanadyl phthalocyanine photogenerator. The addition of dibromoanthanthrone to the vanadyl phthalocyanine significantly improved the photosensitivity of the latter in the range of 450 to 550 nanometers.

Furthermore, two photoresponsive members having a device structure of FIG. 1 were prepared with the exception that a different photogenerator layer was selected. In the first member, the photogenerator layer contains a mixture of vanadyl phthalocyanine and dibromoanthanthrone in 1 to 3 weight ratio, and the second member contains as the photogenerator layer only vanadyl phthalocyanine. FIG. 5, line (A) represents the spectral response of a photoresponsive member incorporating a mixture of vanadyl phthalocyanine and dibromoanthanthrone pigments, in a 1 to 3 ratio by weight, as the photogenerator layer; whereas line (B) shows the spectral response of a photoresponsive imaging member with vanadyl phthalocyanine as the photogenerator layer.

Figure 4:
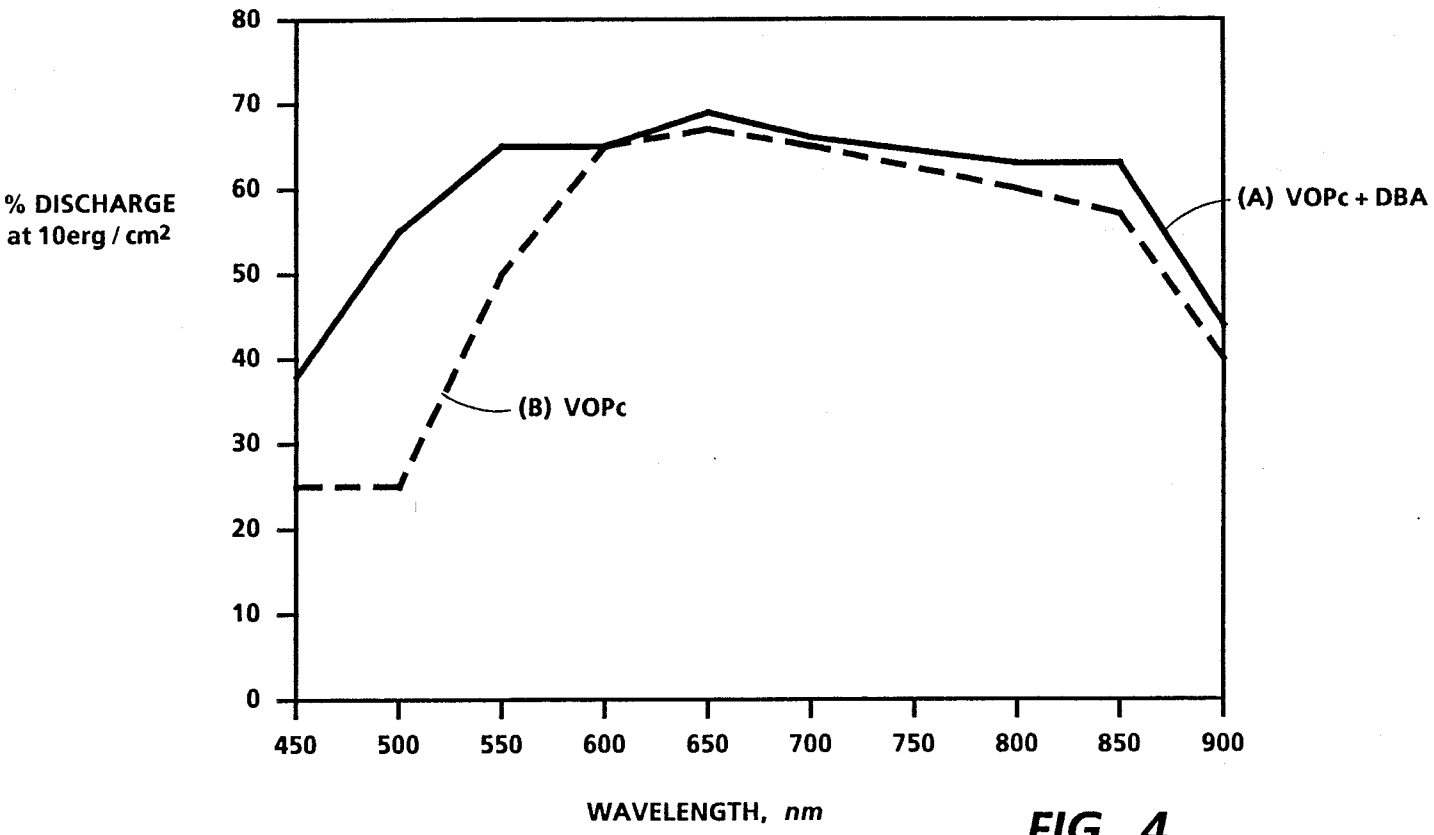
FIG. 4, line (A) illustrates the spectral response characteristics of a photoresponsive member incorporating a mixture of vanadyl phthalocyanine and dibromoanthanthrone pigments in a 1 to 1 weight ratio, whereas line (B) shows the spectral response of an imaging member with vanadyl phthalocyanine.
Figure 5:
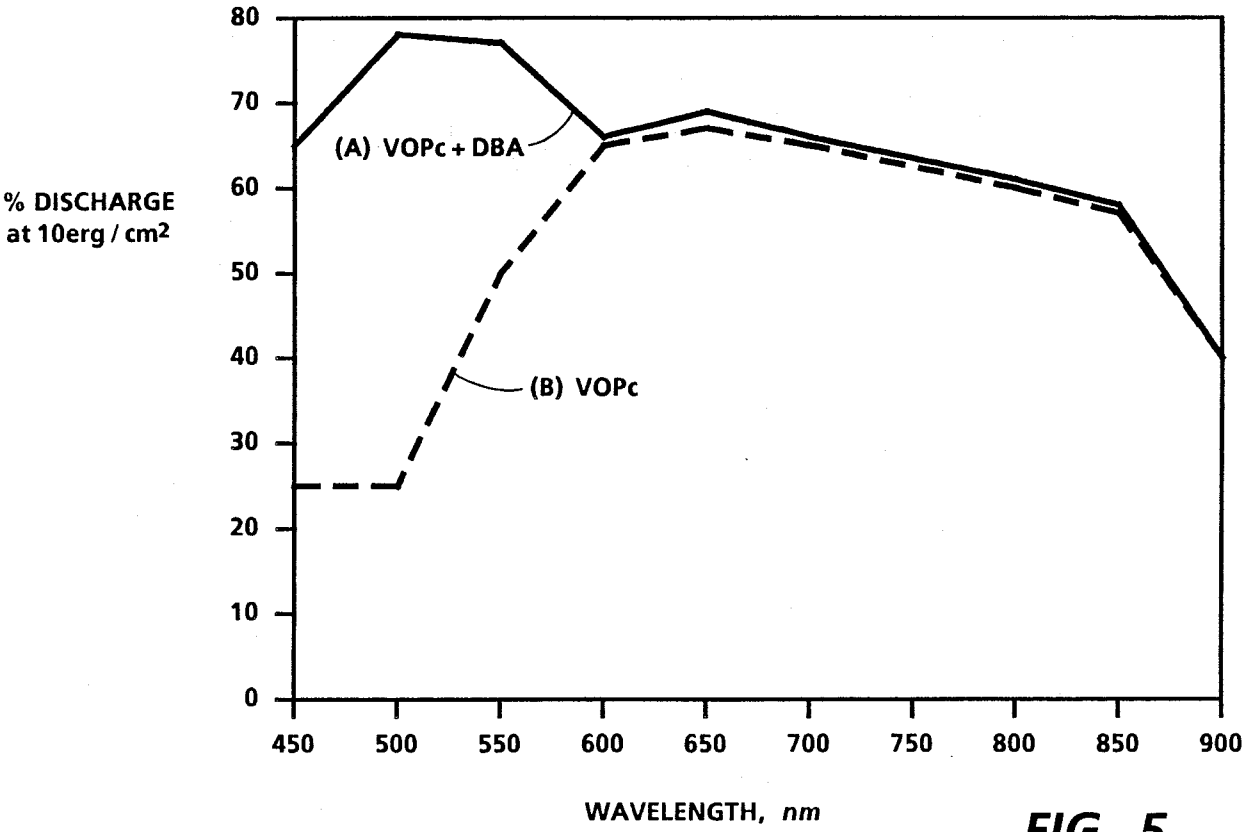
FIG. 5, line (A) represents the spectral response of another photoresponsive member incorporating a mixture of vanadyl phthalocyanine and dibromoanthanthrone pigments in 1 to 3 weight ratio, whereas line (B) shows the spectral response of an imaging member with vanadyl phthalocyanine.

In both FIGS. 4 and 5, the spectral response of vanadyl phthalocyanine in the region of 450 to 550 nanometers is further improved by the presence of the second dibromoanthanthrone pigment. The extent of the improvement in this region is controlled by the amount of dibromoanthanthrone added to the vanadyl phthalocyanine. Accordingly, the adjustment of the spectral characteristics in photoresponsive members can be achieved by controlling the ratio of pigment components used in forming the photogenerating mixture. The improvement of photosensitivity of phthalocyanine by the incorporation of dibromoanthanthrone in this spectral region renders it more responsive to red color image present in original documents to be photocopied, and hence an improved red color copyability is obtained for the imaging member containing the phthalocyanine/dibromoanthanthrone pigment mixture as compared to the member containing only the phthalocyanine.

Substrates selected for the imaging members of the present invention can be opaque of substantially transparent, and may comprise any suitable material having the requisite mechanical properties. Thus, the substrate may comprise a layer of insulating material including inorganic or organic polymeric materials, such as Mylar a commercially available polymer; a layer of an organic or inorganic material having a semiconductive surface layer such as indium tin oxide, or aluminum arranged thereon, or a conductive material inclusive of aluminum, chromium, nickel, brass, or the like. The substrate may be flexible or rigid, and many have a number of many different configurations, such as, for example a plate, a cylindrical drum, a scroll, an endless flexible belt, and the like. Preferably, the substrate is in the form of a seamless flexible belt. In some situations, it may be desirable to coat on the back of the substrate, particularly when the substrate is a flexible organic polymeric material, an anticurl layer, such as, for example, polycarbonate materials commercially available as Makrolon.

The thickness of the substrate layer depends on many factors, including economical considerations, thus this layer may be of substantial thickness, for example over 2,500 microns; or of minimum thickness providing there are no adverse effects on the system. In one preferred embodiment, the thickness of this layer ranges from about 75 microns to about 250 microns.

With further regard to the imaging members of the present invention, the photogenerator layer is preferably comprised of pigment mixtures dispersed in resinous binders. However, providing the objectives of the present invention are achieved, the photogenerator layer may consist of 100 percent of the mixture of pigments disclosed herein. Generally, the thickness of the photogenerator layer depends on a number of factors including the thicknesses of the other layers, and the percent mixture of photogenerator material contained in this layer. Accordingly, this layer can be of a thickness of from about 0.05 micron to about 10 microns when the photogenerator composition is present in an amount of from about 5 percent to about 100 percent by volume. Preferably, this layer is of a thickness of from about 0.1 micron to about 2 microns when the photogenerator composition mixture is present in this layer in an amount of 30 to 90 percent by volume. In one very specific preferred embodiment, the vacuum deposited photogenerating layers are of a thickness of from about 0.07 micron to about 0.5 micron. The maximum thickness of this layer is dependent primarily upon factors such as photosensitivity, electrical properties, and mechanical considerations.

Illustrative examples of polymeric binder resinous materials that can be selected for the photogenerator mixture include those polymers as disclosed in U.S. Pat. No. 3,121,006, the disclosure of which is totally incorporated herein by reference, polyesters, polyvinyl butyral, Formvar ®, polycarbonate resins, polyvinyl carbazole, epoxy resins, polyvinyl chloride, phenoxy resins, especially the commercially available poly(hydroxyether) resins, and the like.

As optional adhesive layers situated on a silane or metal oxide hole blocking layer, there can be selected various known substances inclusive of polyesters such as those commercially available from E. I. DuPont as 49,000 polyesters, nylon, polyvinyl butyral, and polyurethane. This layer is of a thickness of from about 0.05 micron to 1 micron.

Aryl amines selected for the hole transporting layer, which generally is of a thickness of from about 5 microns to about 50 microns, and preferably is of a thickness of from about 10 microns to about 40 microns, include molecules of the following formula

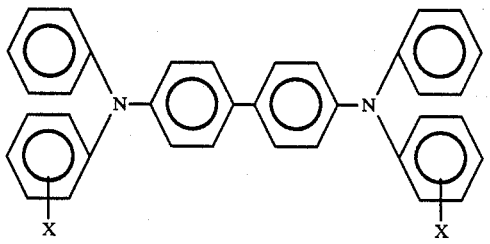

dispersed in a highly insulating and transparent organic resinous binder wherein X is an alkyl group or a halogen, especially those substituents selected from the group consisting of (ortho) $CH_3$, (para) $CH_3$, (ortho) Cl, (meta) Cl, and (para) Cl.

Examples of specific aryl amines are N,N'-diphenyl-N,N'-bis(alkylphenyl)-[1,1-biphenyl]-4,4'-diamine wherein alkyl is selected from the group consisting of methyl such as 2-methyl, 3-methyl and 4-methyl, ethyl, propyl, butyl, hexyl, and the like. With chloro substitution, the amine is N,N'-diphenyl-N,N'-bis(halo phenyl)-[1,1'-biphenyl]-4,4'-diamine wherein halo is 2-chloro, 3-chloro, or 4-chloro.

Examples of the highly insulating and transparent resinous material or inactive binder resinous material for the transport layers include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyesters, polysiloxanes, polyamides, polyurethanes, and epoxies as well as block, random, or alternating copolymers thereof. Preferred electrically inactive binders are comprised of polycarbonate resins having a molecular weight of from about 20,000 to about 100,000 with a molecular weight of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also, included within the scope of the present invention are methods of imaging with the photoresponsive devices illustrated herein. These methods generally involve the formation of an electrostatic latent image on the imaging member, followed by developing the image with a toner composition, subsequently transferring the image to a suitable substrate, and permanently affixing the image thereto. In those environments wherein the device is to be used in a printing mode, the imaging method involves the same steps with the exception that the exposure step can be accomplished with a laser device or image bar.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

Preparation of a Pigment Mixture of Benzimidazole Perylene and Vanadyl Phthalocyanine:

In a 1 liter three-neck flask fitted with mechanical stirrer and temperature probe, 10 grams of benzimidazole perylene, and 10 grams of vanadyl phthalocyanine were slowly added to 800 grams of 96 percent concentrated sulfuric acid, which was maintained at 0° to 5° C. by an external ice cooling bath. The mechanical stirrer was operated at about 300 RPM with vortex (there is a dip in the liquid surface during stirring, and some circular swirling in the liquid enabling mixing to be obtained), and excessive splashing was avoided to ensure complete dissolution of pigments. The acid/pigment solution was stirred for 3 hours while maintaining the temperature at 0° to 5° C. Into a 5 liter flask containing 3.2 liters of deionized water chilled to 0° to 2° C. the acid/pigment solution was added dropwise while the stirrer was operating at 300 RPM. The addition was completed in 1.5 hours and the temperature of the slurry thus formed was kept between 0° to 2° C. At this stage, the slurry contained precipitated benzimidazole perylene and vanadyl phthalocyanine in 20 percent sulfuric acid. The slurry was filtered through a Buchner funnel fitted with a polypropylene filter (pore size 5 microns) under the action of a vacuum. The cake collected on the filter was then washed with 0.2 liter of deionized water and the liquid was removed through the filter by a vacuum. The washing and filtering were repeated two more times. The wet cake was transferred to a 1.5 liter beaker and slurried with 0.8 liter of deionized water for 30 minutes using a magnetic stirring bar. The slurry was filtered through a Buchner funnel by vacuum suction. The preparation of the slurry and filtration was repeated until the pH of the filtrate was 5 or greater. Then the cake resulting was slurried in 0.8 liter of deionized water at 70° to 80° C. for 1 hour and filtered. The slurrying in the aforementioned hot deionized water followed by filtration was performed at least three times or until the conductivity of the filtrate is less than 10 micromhos. The final washings were performed by slurrying the wet cake with 0.4 liter solution of 20 volume percent deionized water and 80 volume percent methanol for 30 minutes, and the pigment mixture was separated by filtration. The procedure was repeated two more times. The wet cake was placed in a vacuum oven at 90° C. and dried over 16 hours. The yield of a 1:1 mixture of benzimidazole perylene and vanadyl phthalocyanine was 18 grams.

EXAMPLE II

A photoresponsive imaging member (FIG. 3) incorporating 1:1 benzimidazole perylene/vanadyl phthalocyanine pigment mixture as a photogenerator layer was prepared as follows: 0.17 gram of benzimidazole perylene/vanadyl phthalocyanine pigment mixture obtained from Example I was mixed with 0.4 gram of Goodyear's PE200 polyester adhesive in a 30 cc glass bottle containing 70 grams of ⅛ inch stainless steel shots and 13.5 grams of methylene chloride. The bottle was placed on a roller mill and the dispersion was milled for 24 hours. The slurry was coated onto a titanium metallized Mylar substrate in a thickness of 3 mils using a film applicator of 1 mil gap. Thereafter, the photogenerator layer formed was dried in a forced air oven at 135° C. for 20 minutes to a thickness of 0.5 micron. Therafter, the photogenerator layer was overcoated with an amine charge transport layer prepared as follows: 65 percent by weight Makrolon, a polycarbonate resin, was mixed with the 35 percent by weight N,N'-diphenyl-N,N'-bis(3-methylphenyl)-1,1'-biphenyl-4,4'-diamine. The mixture was dissolved to 7 percent by weight in methylene chloride in an amber bottle. The resulting solution was then coated to a dry thickness of 20 microns on top of the above photogenerator layer using a multiple clearance film applicator (10 milliliter gap). The resulting member was then dried in a forced air oven at 135° C. for 20 minutes.

The photosensitivity of this member was determined in the following manner. The member was electrostatically charged in the dark with a corona discharge source operating in the range of −5.0 to −6.0 KV and an initial surface potential $V_o$ was measured by a capacitively coupled probe attached to an electrometer. The front surface of the charged member was then exposed to light from a filtered Xenon lamp, XBO 75 watt source, allowing monochromatic light in the wavelength range 400 to 900 nanometers to reach the member surface. After the light exposure the surface potential was reduced and a final surface potential $V_b$ was measured. The percent discharge for each exposure energy was calculated according to the equation, percent discharge$\times(V_o-V_b)/Vo\times 100$ percent. From the plot of the percent discharge versus exposure energy, the percent discharge at an exposure energy of 10 erg/cm$^2$ was determined. The percent discharge at 10 erg/cm$^2$ was used as a measure of photosensitivity of the photoresponsive member. The higher the percent discharge, the higher is the photosensitivity. The spectral response curve was constructed by plotting the values of percent discharge at 10 erg/cm$^2$ against wavelength of exposure light used. Line (A) in FIG. 3 represents the spectral response of the aforementioned photoresponsive member incorporating a photogenerator layer, which is comprised of a pigment mixture in 1 to 1 ratio of benzimidazole perylene and vanadyl phthalocyanine dispersed in PE200.

For comparision, a photoresponsive member was prepared in similar manner with the exception that only 0.17 gram benzimidazole perylene pigment, instwead of pigment mixture, was used as the photogenerator layer. The spectral response curve for this member is represented as line (B) in FIG. 3. Thus, the presence of vanadyl phthalocyanine significantly extends the spectral response of benzimidazole perylene to 900 nanometers. The benzimidazole perylene itself shows decreasing photosensitivity beyond 720 nanometers.

EXAMPLE III

A series of photoresponsive elements (FIG. 3) incorporating, for example, different mixture ratios of vanadyl phthalocyanine (VOPc) and dibromoanthanthrone (DBA) as a photogenerator layer were fabricated by repeating the procedure of Example II. The photogenerator dispersions were prepared by roll milling pigments, Makrolon, 19 grams of methylene chloride, and 100 grams of ⅛ inch stainless steel shots in 2 ounce bottles. The amounts of pigments and Makrolon used were as follows:

| Photogenerator Dispersion | a | b | c |
|---|---|---|---|
| Ratio of VOPc to DBA | 1:0 | 1:1 | 1:3 |
| Weight of VOPc,g | 0.16 | 0.16 | 0.16 |
| Weight of DBA,g | 0 | 0.16 | 0.48 |
| Weight of Makrolon,g | 1.08 | 0.96 | 0.72 |

The photogenerator dispersions were milled for 24 hours and were coated onto titanium metallized mylar sheets in a thickness of 3 mils using a 0.5 mil Bird's bar. The photogenerator layers were dried in a forced air oven at 135° C. for 5 minutes. The resulting layers have a dry thickness of 2 microns.

The above photogenerator layers were then overcoated with a charge transport layer which was prepared as follows:

A transport layer solution was prepared by introducing into an amber glass bottle in a weight ratio of 1:1 N,N'-diphenyl-N,N'-bis(3-methylphenyl)-1,1'-biphenyl-4,4'-diamine and Makrolon, a polycarbonate resin, having a molecular weight (Mw) of from about 50,000 to about 100,000 available from Larbensabricken Bayer A. G. This mixture was dissolved in 15 percent by weight methylene chloride. The solution was coated to a dry 25 micron thickness layer on top of the above photogenerator layers using a Bird applicator. The resulting devices containing all of the above layers were annealed at 135° C. in a forced air oven for 6 minutes.

Each of the above prepared photoresponsive devices were then tested for photosensitivity in the visible and infrared region of spectrum by negatively charging the devices with a corotron to −800 volts followed by exposing each device to monochromatic light in the wavelength range from 400 to 900 nanometers. The percent discharge at 10 erg/cm$^2$ of exposure energy was determined as described in Example II.

In FIG. 4, line (A) represents the spectral response of the photoresponsive element incorporating a 1:1 mixture of vanadyl phthalocyanine and dibromoanthanthrone as a photogenerator. Line (B) is the spectral response curve obtained for the device containing only vanadyl phthalocyanine photogenerator.

In FIG. 5, line (A) represents the spectral response of the photoresponsive element incorporating a 1:3 mixture of vanadyl phthalocyanine and dibromoanthanthrone as a photogenerator. Line (B) is the spectral response curve obtained for the device containing only vanadyl phthalocyanine as the photogenerator.

The results in FIGS. 4 and 5 illustrate that dibromoanthanthrone has improved the spectral response characteristics of vanadyl phthalocyanine in the region of 450 to 550 nanometers. The improvement of spectral sensitivity in this region will result in better response of the imaging member toward red color, and hence red color copyability of phthalocyanine is enhanced.

Images can be obtained with the imaging members of the present invention in electrophotographic, especially xerographic, imaging and printing apparatuses with known developer compositions including those as illustrated in U.S. Pat. Nos. 4,560,635; 4,469,770; 4,298,672; 3,590,000; 3,969,251; 4,264,697; and copending applicatons U.S. Ser. Nos. 136,791, and 136,792, the disclosures of each of these patents and applications being totally incorporated herein by reference.

Other modifications of the present invention may occur to those skilled in the art based upon a reading of the present disclosure and these modifications, including equivalents thereof, are intended to be included within the scope of the present invention.

What is claimed is:

1. A layered photoresponsive imaging member comprised of a supporting substrate; a photogenerator layer comprised of a mixture of first and second pigments, said mixture being selected from the group consisting of perylenes and phthalocyanines; polycyclic quinones and phthalocyanines; and perinones and phthalocyanines; and a hole transport layer comprising molecules of the following formula

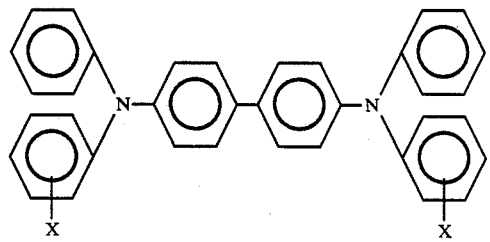

dispersed in a resinous binder, and wherein X is selected from the group consisting of halogen and alkyl, wherein the imaging member exhibits photosensitivity in the wavelength range of from about 400 to about 900 nanometers.

2. A layered photoresponsive imaging member in accordance with claim 1 wherein the photogenerator perylenes are benzimidazole perylene, or N,N'-diphenyl-3,4,9,10-perylenebis(dicarboximide); the phthalocyanines are vanadyl phthalocyanine, or chloroindium phthalocyanine; the polycyclic quinones are chlorinated or brominated anthanthrone, and chlorinated or brominated pyranthrones; and the perinones are benzimidazole or naphthimidazole perinones.

3. A layered photoresponsive imaging member in accordance with claim 1 wherein the mixture is comprised of from about 10 to about 90 percent of the first pigment, and from about 90 to about 10 percent of the second pigment.

4. A layered photoresponsive imaging member in accordance with claim 1 wherein the aryl amine is comprised of molecules of the following formula

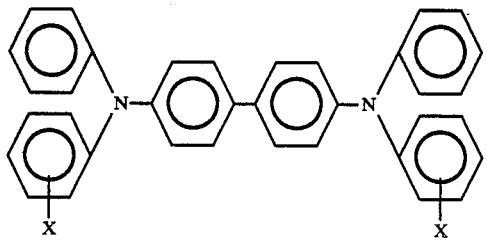

dispersed in a resinous binder, and wherein X is selected from the group consisting of halogen and alkyl.

5. An imaging member in accordance with claim 1 wherein X is selected from (ortho) $CH_3$, (meta) $CH_3$, (para) $CH_3$, (ortho) Cl, (meta) Cl, and (para) Cl.

6. An imaging member in accordance with claim 1 wherein the supporting substrate is comprised of a conductive metallic substance, or an insulating polymeric composition overcoated with an electrically conductive layer.

7. An imaging member in accordance with claim 1 wherein the supporting substrate is aluminum.

8. An imaging member in accordance with claim 1 wherein the supporting substrate is overcoated with a polymeric adhesive layer.

9. An imaging member in accordance with claim 8 wherein the adhesive layer is comprised of a polyester.

10. An imaging member in accordance with claim 1 wherein the aryl amine is N,N'-diphenyl-N,N'-bis(3-methylphenyl)-[1,1'-biphenyl]-4,4'-diamine.

11. An imaging member in accordance with claim 1 wherein the resinous binder is a polycarbonate or poly(-vinylcarbazole).

12. An imaging member in accordance with claim 1 wherein the photogenerating pigment mixture is dispersed in a resinous binder in an amount of from about 5 percent to about 95 percent by volume, and the aryl amine hole transport molecules are dispersed in a resinous binder in an amount of from about 10 to about 75 percent by weight.

13. An imaging member in accordance with claim 12 wherein the resinous binder for the photogenerator pigments is a polyester, polyvinylcarbazole, polyvinylbutyral, a polycarbonate, or a phenoxy resin; and the resinous binder for the aryl amine hole transport material is a polycarbonate, a polyester, or a vinyl polymer.

14. An imaging member in accordance with claim 1 wherein the aryl amine hole transport layer is situated between the supporting substrate and a vacuum deposited photogenerating layer.

15. An imaging member in accordance with claim 14 comprised of a supporting substrate, and a photogenerator layer comprised of a mixture of pigments.

16. An imaging member in accordance with claim 15 wherein the supporting substrate is comprised of a conductive metallic substance, or an insulating polymeric composition overcoated with an electrically conductive layer.

17. An imaging member in accordance with claim 16 wherein the supporting substrate is aluminum.

18. An imaging member in accordance with claim 16 wherein the supporting substrate is overcoated with a thin polymeric adhesive layer.

19. An imaging member in accordance with claim 15 wherein X is selected from (ortho) $CH_3$, (meta) $CH_3$, (para) $CH_3$, (ortho) Cl, (meta) Cl, and (para) Cl.

20. An imaging member in accordance with claim 19 wherein the aryl amine is N,N'-diphenyl-N,N'-bis(3-methylphenyl)-[1,1'-biphenyl]-4,4'-diamine.

21. An imaging member in accordance with claim 15 wherein the resinous binder is a polycarbonate or poly(-vinylcarbazole).

22. An imaging member in accordance with claim 15 wherein the pigments are dispersed in a resinous binder in an amount of from about 5 percent to about 95 percent by volume, and the aryl amine hole transport molecules are dispersed in a resinous binder in an amount of from about 10 to about 75 percent by weight.

23. A method of imaging which comprises forming an electrostatic latent image on the imaging member of claim 1; affecting development thereof with toner particles; subsequently transferring the developed image to a suitable substrate; and permanently affixing the image thereto.

24. A method of imaging which comprises forming an electrostatic latent image on the imaging member of claim 14; affecting development thereof with toner particles; subsequently transferring the developed image to a suitable substrate; and permanently affixing the image thereto.

25. An imaging member in accordance with claim 1 wherein the photogenerating mixture is comprised of a 1:1 ratio of benzimidazole perylene and vanadyl phthalocyanine dispersed in from about 30 to about 50 weight percent in a resinous binder.

26. An imaging member in accordance with claim 1 wherein the mixture is comprised of vanadyl phthalocyanine and dibromoanthanthrone in a ratio of from about 1:1 to about 1:3 ratio by weight dispersed in a resinous binder in an amount of from about 30 to about 50 weight percent.

27. An imaging member in accordance with claim 1 wherein the mixture of pigments comprises phthalocyanines and perylenes selected from the group consisting of:

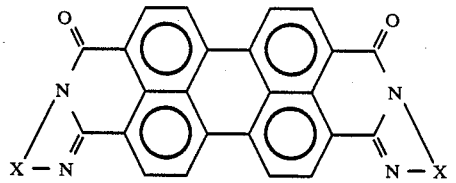

CIS

-continued

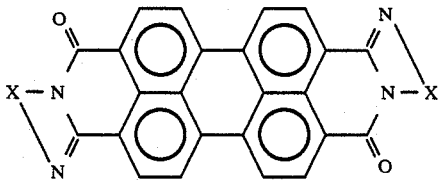

TRANS wherein X is o-phenylene, pyridimediyl, pyrimidinediyl, phenanthrenediyl, naphthalenediyl, and the corresponding methyl, nitro, chloro, and methoxy substituted derivatives; and

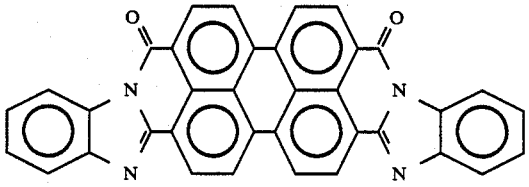

CIS

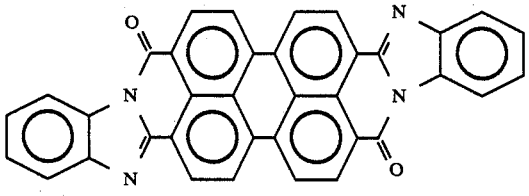

TRANS

28. An imaging member in accordance with claim 27 wherein the perylene is a mixture of the cis and trans isomers of the following formulae:

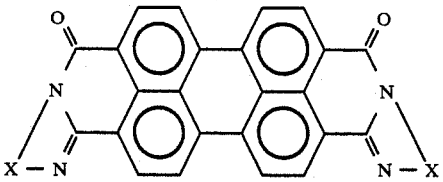

CIS

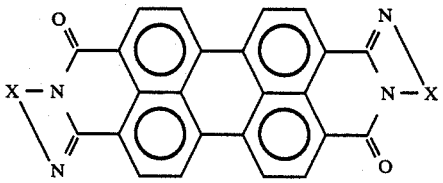

-continued

TRANS wherein X is o-phenylene, pyridimediyl, pyrimidinediyl, phenanthrenediyl, naphthalenediyl, and the corresponding methyl, nitro, chloro, and methoxy substituted derivatives.

29. An imaging member in accordance with claim 27 wherein the perylene is of the following formula:

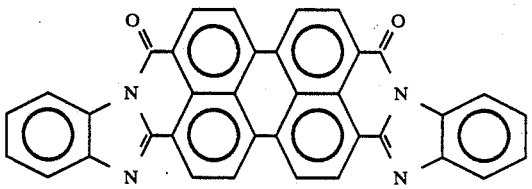

CIS

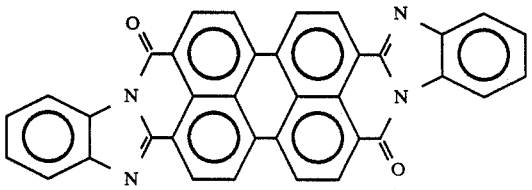

TRANS

30. An imaging member in accordance with claim 1 wherein the mixture of pigments comprises phthalocyanines and polycyclic quinones selected from the group consisting of anthanthrone, halogenated anthanthrones, pyranthrone, halogenated pyranthrones, dibenzyrenequinone, and halogenated dibenzyrenequinones.

31. An imaging member in accordance with claim 30 wherein the polycyclic quinone is selected from the group consisting of anthanthrone and halogenated anthanthrones.

32. An imaging member in accordance with claim 30 wherein the polycyclic quinone is selected from the group consisting of pyranthrone and halogenated pyranthrones.

33. An imaging member in accordance with claim 30 wherein the polycyclic quinone is selected from the group consisting of dibenzyrenequinone and halogenated dibenzyrenequinones.

34. An imaging member in accordance with claim 1 wherein the mixture of pigments comprises phthalocyanines and perinones selected from the group consisting of benzimidazole perinones and naphthimidazole perinones.

35. An imaging member in accordance with claim 34 wherein the perinone is a benzimidazole perinone.

36. An imaging member in accordance with claim 34 wherein the perinone is a naphthimidazole perinone.

* * * * *